US011851737B2

(12) United States Patent
Michelet et al.

(10) Patent No.: US 11,851,737 B2
(45) Date of Patent: Dec. 26, 2023

(54) BALANCE SPRING FOR A HOROLOGICAL MOVEMENT

(71) Applicant: Nivarox-FAR S.A., Le Locle (CH)

(72) Inventors: Lionel Michelet, Fleurier (CH); Christian Charbon, Chézard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 17/657,664

(22) Filed: Apr. 1, 2022

(65) Prior Publication Data

US 2023/0031063 A1 Feb. 2, 2023

(30) Foreign Application Priority Data

Jul. 23, 2021 (EP) ..... 21187512

(51) Int. Cl.
*C22C 27/02* (2006.01)
*G04B 17/06* (2006.01)

(52) U.S. Cl.
CPC ..... *C22C 27/02* (2013.01); *G04B 17/066* (2013.01)

(58) Field of Classification Search
None
See application file for complete search history.

(56) References Cited

U.S. PATENT DOCUMENTS

2020/0308685 A1 10/2020 Laheurte et al.
2020/0356057 A1 11/2020 Charbon
2021/0200153 A1 7/2021 Charbon

FOREIGN PATENT DOCUMENTS

CH 714 494 A2 6/2019
WO WO 2018/172164 A1 9/2018

OTHER PUBLICATIONS

Popov et al. "Influence of Hydrogen on the Phase Composition and Structure of Hardened Alloys Ti—Nb." Metals, issue 5. 1994. pp. 109-117. (Year: 1994).*
Popov et al. "On the Nature of the X-Phase in Ti—Nb—H Alloys." Metals, issue 6. 1995. pp. 52-58. (Year: 1995).*
English language translation of "Influence of Hydrogen on the Phase Composition and Structure of Hardened Alloys Ti—Nb" by Popov et al. Translated Apr. 2023. (Year: 2023).*
English language translation of "On the Nature of the X-Phase In Ti—Nb—H Alloys" by Popov et al. Translated Apr. 2023. (Year: 2023).*

(Continued)

*Primary Examiner* — Brian D Walck
(74) *Attorney, Agent, or Firm* — Oblon, McClelland, Maier & Neustadt, L.L.P.

(57) ABSTRACT

A balance spring intended to equip a balance of a horological movement, wherein the balance spring is made of an alloy consisting of Nb, Ti, H and possible traces of other elements selected from O, C, Fe, N, Ni, Si, Cu and Al, with the following weight percentages: a Ti content comprised between 1 and 80 wt %, a H content comprised between 0.17 and 2 wt %, a total content of all other elements of less than or equal to 0.3 wt %, the remainder to 100 wt % consisting of Nb. A manufacturing method for the balance spring is also disclosed and includes a step of thermochemically treating a blank made of a Nb and Ti alloy in an atmosphere including hydrogen so as to enrich the Nb and Ti alloy with hydrogen in interstitial form.

19 Claims, 3 Drawing Sheets

(56) References Cited

OTHER PUBLICATIONS

European Search Report dated Dec. 15, 2021 in European Application 21187512.5, filed on Jul. 23, 2021, 3 pages (with English Translation of Categories of cited documents).
"Oscillateur pour piece d'horlogerie", IP.com, IP.com Inc., West Henrietta, NY, US. XP013189494, May 28, 2021 (6 pages).
Eliaz, N. et al. "Hydrogen-assisted processing of materials" Materials Science and Engineering A. vol. 289, No. 1-2, Sep. 1, 2000 (13 pages).
Indian Office Action dated Mar. 21, 2023 in Indian Patent Application No. 202244041252, 7 pages.

* cited by examiner

BALANCE SPRING FOR A HOROLOGICAL MOVEMENT

CROSS-REFERENCE TO RELATED APPLICATION

This application claims priority to European Patent Application No. 21187512.5 filed on Jul. 23, 2021, the entire disclosure of which is hereby incorporated herein by reference.

FIELD OF THE INVENTION

The invention relates to a balance spring intended to equip a balance of a horological movement. It further relates to the method for manufacturing this balance spring.

BACKGROUND OF THE INVENTION

The manufacture of balance springs for horology is subject to restrictions that often appear irreconcilable at first sight:

- the need to obtain a high yield strength,
- an ease of manufacture, particularly of wire drawing and rolling operations,
- an excellent fatigue strength,
- stable performance levels over time,
- small cross-sections.

The alloy chosen for a balance spring must also have properties that guarantee maintained timing performances despite the variation in the temperatures of use of a watch incorporating such a balance spring. The thermoelastic coefficient, or CTE, of the alloy is thus very important. In order to form a chronometric oscillator with a balance made of CuBe or nickel-silver, a CTE of +/−10 ppm/° C. must be achieved.

The formula connecting the CTE of the alloy and the expansion coefficients of the balance spring (α) and of the balance (β) to the thermal coefficient (CT) of the oscillator is provided below:

$$CT = \frac{dM}{dT} = \left(\frac{1}{2E}\frac{dE}{dT} - \beta + \frac{3}{2}\alpha\right) \times 86400 \frac{s}{\text{day } ^\circ\text{C.}}$$

the variables M and T being respectively the rate in s/d and the temperature in ° C., E being the Young's modulus of the balance spring with (1/E. dE/dT) being the CTE of the balance spring alloy, the coefficients of expansion being expressed in ° C.$^{-1}$.

In practice, the CT is calculated as follows:

$$CT = \frac{(M_{38^\circ C.} - M_{8^\circ C.})}{30}$$

with a value that must be comprised between −0.6 and +0.6 s/d° C.

In the prior art, balance springs for the horology industry are known to be made of binary Nb—Ti alloys with Ti percentages by weight typically comprised between 40 and 60 wt % and more specifically with a percentage of 47 wt %. With a deformation pattern and adapted heat treatments, this balance spring has a two-phase microstructure with a solid solution of Nb and Ti in the beta phase and Ti in the form of precipitates in the alpha phase. The solid solution of cold-rolled beta-phase Nb and Ti has a highly positive CTE, whereas the alpha-phase Ti has a highly negative CTE, allowing the two-phase alloy to be brought to a CTE close to zero, which is particularly beneficial for the CT.

However, there are some drawbacks to the use of binary Nb—Ti alloys for balance springs. The binary Nb—Ti alloy is particularly beneficial for a low CT as mentioned hereinabove. However, the composition thereof is not optimised for the middle-temperature error, which is a measurement of the curvature of the rate that is approximated hereinabove by a straight line through two points (8° C. and 38° C.). The rate can deviate from this linear behaviour between 8° C. and 38° C. and the middle-temperature error at 23° C. is a measurement of this deviation at the temperature of 23° C. It is calculated according to the following formula:

$$ES_{23^\circ C.} = M_{23^\circ C.} - \frac{(M_{8^\circ C.} + M_{38^\circ C.})}{2}$$

Typically, for a NbTi47 alloy, the middle-temperature error is +4.5 s/d, whereas it should preferably be comprised between −3 and +3 s/d.

SUMMARY OF THE INVENTION

The purpose of the invention is to propose a new manufacturing method and a new chemical composition for balance springs allowing the middle-temperature error to be reduced, while maintaining a thermal coefficient close to 0.

For this purpose, the invention relates to a horological balance spring made of a niobium, titanium and hydrogen alloy. More specifically, the balance spring is made of an alloy consisting of:

- Nb, Ti, H and possible traces of other elements selected from O, C, Fe, N, Ni, Si, Cu and Al, with the following weight percentages:

- a Ti content comprised between 1 and 80 wt %,
- a H content comprised between 0.17 and 2 wt %,
- a total content of all other elements of less than or equal to 0.3 wt %,
- the remainder to 100 wt % consisting of Nb.

The addition of hydrogen makes it possible to produce a balance spring with a middle-temperature error close to 0 and simultaneously with a thermal coefficient close to 0.

According to the invention, hydrogen is added to the Nb—Ti alloy by thermochemical treatment under a controlled atmosphere during the manufacturing method.

More specifically, the manufacturing method successively comprises:

a) a step of producing or of supplying a blank made of an alloy consisting of Nb, Ti and possible traces of other elements selected from O, C, Fe, N, Ni, Si, Cu and Al, with a Ti content comprised between 1 and 80 wt % and a total content of all other elements of less than or equal to 0.3 wt %, the remainder to 100 wt % consisting of Nb, b) a step of beta-type solution treating and quenching said blank, so that the titanium and niobium of said alloy are essentially in the form of a beta-phase solid solution, c) a step of applying to said alloy a succession of deformation sequences optionally with at least one heat treatment between two sequences and/or after the succession of deformation sequences, d) a winding step for forming the balance spring, e) a final so-called fixing heat treatment step, the method being characterised in that it comprises an additional thermochemical treatment step in an atmosphere comprising hydrogen, said thermochemical treatment step being carried out during the solution treatment of step b), during a heat treatment of step c), during the final heat treatment of step e), before step b), between steps b) and c), between steps c) and d), between steps d) and e) or after step e).

Advantageously, the thermochemical treatment is carried out on a recrystallised structure.

The balance spring thus produced contains hydrogen predominantly or exclusively in interstitial form. The term 'predominantly', as opposed to 'exclusively' must be understood to mean that the very localised presence of a small proportion of hydrides cannot be excluded. With regard to the microstructure thereof, it is formed by a single beta phase of Nb and Ti in a solid solution.

In addition to the low middle-temperature error thereof and the low thermal coefficient thereof, the balance spring produced using the method according to the invention has an ultimate tensile strength Rm of greater than or equal to 500 MPa and more precisely comprised between 800 and 1,000 MPa. Advantageously, it has a modulus of elasticity of greater than or equal to 80 GPa and preferably greater than or equal to 90 GPa.

Other features and advantages of the invention will appear upon reading the following detailed description.

DETAILED DESCRIPTION

Figure 1:
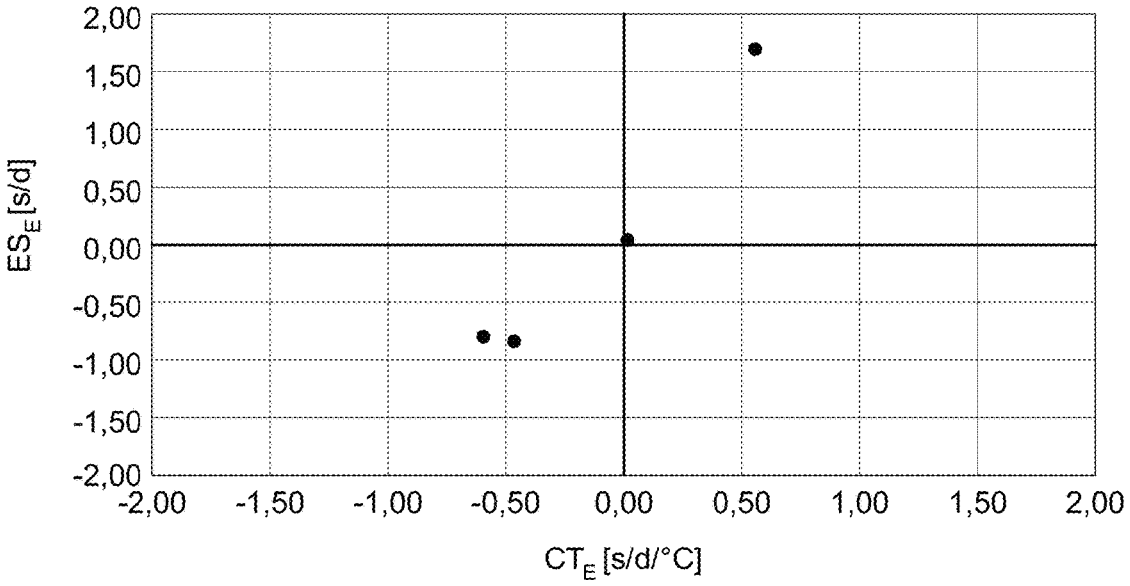
FIG. 1 shows the middle-temperature error as a function of the thermal coefficient for ternary Nb—Ti—H grades according to the invention with 47 wt % Ti.

The invention relates to a horological balance spring made of a niobium (Nb), titanium (Ti) and hydrogen (H) alloy. More specifically, the alloy consists of:

Nb, Ti, H and possible traces of other elements selected from O, C, Fe, N, Ni, Si, Cu and Al, with the following weight percentages:

a Ti content comprised between 1 and 80 wt %, a H content comprised between 0.17 and 2 wt %, a total content of all other elements present in trace form of less than or equal to 0.3 wt %, the remainder to 100 wt % consisting of Nb.

Preferably, the hydrogen content is comprised between 0.2 and 1.5 wt %, more preferably between 0.5 and 1 wt %.

Preferably, the titanium content is comprised between 20 and 60 wt %, preferably between 40 and 50 wt %.

The alloy used in the present invention does not comprise any elements other than Ti, Nb and H, except any potential and unavoidable traces.

More particularly, the oxygen content is less than or equal to 0.10 wt % of the total composition, or even less than or equal to 0.085 wt % of the total composition.

More particularly, the carbon content is less than or equal to 0.04 wt % of the total composition, in particular less than or equal to 0.020 wt % of the total composition, or even less than or equal to 0.0175 wt % of the total composition.

More particularly, the iron content is less than or equal to 0.03 wt % of the total composition, in particular less than or equal to 0.025 wt % of the total composition, or even less than or equal to 0.020 wt % of the total composition.

More particularly, the nitrogen content is less than or equal to 0.02 wt % of the total composition, in particular less than or equal to 0.015 wt % of the total composition, or even less than or equal to 0.0075 wt % of the total composition.

More particularly, the silicon content is less than or equal to 0.01 wt % of the total composition.

More particularly, the nickel content is less than or equal to 0.01 wt % of the total composition, in particular less than or equal to 0.16 wt % of the total composition.

More particularly, the copper content is less than or equal to 0.01 wt % of the total composition, in particular less than or equal to 0.005 wt % of the total composition.

More particularly, the aluminium content is less than or equal to 0.01 wt % of the total composition.

According to the invention, the alloy is enriched with hydrogen via a thermochemical treatment in an atmosphere comprising hydrogen as carrier gas.

This thermochemical treatment can be carried out at different steps of the method for manufacturing the balance spring, the steps of the method being as follows:

a) producing or supplying a blank made of an alloy consisting of Nb, Ti and possible traces of other elements selected from O, C, Fe, N, Ni, Si, Cu and Al, with a Ti content comprised between 1 and 80 wt % and a total content of all other elements of less than or equal to 0.3 wt %, the remainder to 100 wt % consisting of Nb, b) so-called beta-type solution treating and quenching said blank, so that the titanium and niobium are essentially in the form of a beta-phase solid solution, c) applying, to said alloy, deformation sequences, optionally with one or more heat treatments. The term 'deformation' is understood herein to mean a deformation by wire drawing and/or rolling. Wire drawing can require the use of one or more drawplates in the same sequence or in different sequences if necessary. Wire drawing is carried out until a wire having a round cross-section is obtained. Rolling can be carried out during the same deformation sequence as the wire drawing, or in another sequence. Advantageously, the last sequence applied to the alloy is a rolling operation, preferably having a rectangular profile that is compatible with the inlet cross-section for a winder spindle, d) winding to form a balance spring, e) carrying out a final fixing heat treatment.

According to the invention, the thermochemical treatment can be carried out during the solution treatment of step b), during a heat treatment of step c), during the final fixing heat treatment of step e) or between steps a) and b), b) and c), c) and d), d) and e) or after step e). Advantageously, this treatment is carried out in step e) at the end of the manufacturing method. Carrying out the thermochemical treatment at the end of the manufacturing method prevents any possible release of hydrogen into the atmosphere during any subsequent step that may be carried out, for example, under a vacuum. This also allows the geometry of the spring, the thermal coefficient and the middle-temperature error to be fixed during a single heat treatment.

The thermochemical treatment is carried out at a holding temperature comprised between 100 and 900° C., preferably between 500 and 800° C., more preferably between 600 and 700° C. in an atmosphere comprising hydrogen. The thermochemical treatment can be carried out in an atmosphere containing 100% $H_2$ with an absolute pressure comprised between 5 mbar and 10 bar, preferably between 0.5 and 7 bar, more preferably between 1 and 6 bar, even more preferably between 3.5 and 4.5 bar. The thermochemical treatment can also be carried out in an atmosphere containing a gas mixture, for example a mixture of Ar and $H_2$, at a total pressure comprised between 5 mbar and 10 bar, preferably between 0.5 and 7 bar, more preferably between 1 and 6 bar, even more preferably between 3.5 and 4.5 bar, with a volume percentage of $H_2$ comprised between 5 and 90 vol %. Advantageously, the thermochemical treatment is carried out for a duration comprised between 1 minute and 5 hours.

In step b), the so-called beta type solution and quenching treatment, prior to the deformation sequences, is a treatment carried out in a vacuum at a temperature comprised between 600° C. and 1,000° C. for a duration comprised between 5 minutes and 2 hours, followed by cooling under a gas. More particularly, the treatment is carried out at 800° C. for 1 hour in a vacuum and is followed by cooling under a gas.

In step c), each deformation sequence is carried out with a given deformation ratio comprised between 1 and 5, this deformation ratio satisfying the conventional formula 2ln (d0/d), where d0 is the diameter of the last beta quench, and where d is the diameter of the cold-rolled wire. The overall cumulation of the deformations for the entirety of this succession of sequences produces a total deformation ratio comprised between 1 and 14.

More particularly, the method includes between one and five deformation sequences.

More particularly, the first sequence includes a first deformation with at least a 30% section decrease.

More particularly, each sequence, aside from the first, includes a deformation with at least a 25% section decrease.

Between the deformation sequences and/or after all of the deformation sequences, a heat treatment can be carried out. This heat treatment can have several purposes: to carry out a beta-type solution and quenching treatment as described hereinabove, to precipitate the alpha phase of titanium or to recover/recrystallise the structure. The beta-type solution and quenching treatment is carried out in a vacuum at a temperature comprised between 600° C. and 1,000° C. for a duration comprised between 5 minutes and 2 hours, followed by cooling under a gas. The precipitation of the alpha phase of titanium is carried out at a temperature comprised between 300 and 500° C. for a duration comprised between 1 h and 200 h. The recovery/recrystallisation is carried out at a temperature comprised between 500 and 600° C. for a duration comprised between 30 minutes and 20 h.

In step e), the final heat treatment is carried out for a duration comprised between 1 hour and 200 hours at a temperature comprised between 300° C. and 700° C. More particularly, the duration is comprised between 5 hours and 30 hours at a holding temperature comprised between 400° C. and 600° C.

Furthermore, the method can advantageously include an additional step, which is carried out after step a) of producing or supplying said alloy blank, and before the deformation sequences in step c), of adding, to the blank, a surface layer of ductile material, taken from among copper, nickel, cupronickel, cupromanganese, gold, silver, nickel-phosphorus Ni—P and nickel-boron Ni—B or similar, in order to ease the wire shaping operation during deformation. Moreover, between the final deformation sequences, after the deformation sequences or after the winding step d), the layer of the ductile material is removed from the wire, in particular by etching.

In an alternative embodiment, the surface layer of ductile material is deposited so as to form a balance spring, the pitch whereof is not a multiple of the thickness of the strip. In another alternative embodiment, the surface layer of ductile material is deposited so as to form a spring, the pitch whereof is variable.

In a specific horological application, ductile material is thus added at a given time to facilitate the wire shaping operation, so that a thickness of 10 to 500 micrometres remains on the wire, which has a final diameter of 0.3 to 1 millimetre. The layer of ductile material is removed from the wire, in particular by etching, then the wire is rolled flat before the actual manufacture of the spring itself by winding. Alternatively, the layer of ductile material is removed after flat rolling and before winding.

The addition of ductile material can be galvanic or mechanical; in this case it is a sleeve or a tube of ductile material, which is adjusted on an alloy bar with a large diameter, which is then thinned out during the steps of deforming the composite bar.

The removal of the layer can in particular be carried out by etching with a cyanide-based or acid-based solution, for example nitric acid.

Returning to the additional thermochemical treatment step, the purpose of adding hydrogen is to reduce the middle-temperature error. Tests were carried out on a binary Nb—Ti alloy with 47 wt % Ti and 53 wt % Nb. The thermochemical treatment was carried out during the final fixing heat treatment in step e) in an atmosphere comprising 100% $H_2$ with the conditions given in Table 1 hereinbelow. The thermochemical treatment was carried out either on a recrystallised structure (R) which had been subjected to deformation sequences ending in a heat treatment for recrystallisation, or on a cold-rolled structure (E) following deformation sequences without subsequent heat treatment for recrystallisation. The middle-temperature error (ES) was measured at 23° C. using the following formula:

$$ES_{23^\circ C.} = M_{23^\circ C.} - \frac{(M_{8^\circ C.} + M_{38^\circ C.})}{2}$$

This is the rate variation at 23° C. from the straight line connecting the rate at 8° C. to the rate at 38° C. For example, the rate at 8° C., 23° C. and 38° C. can be measured with a Witschi chronoscope. The thermal coefficient (CT) was measured using the following formula:

$$CT = \frac{(M_{38^\circ C.} - M_{8^\circ C.})}{30}$$

using the same appliance.

The measurement results are provided in Table 1.

TABLE 1

| Sample | State | Duration TT [min] | Temperature [° C.] | $H_2$ pressure [bar] | $CT_E$ [s/d/° C.] | $ES_E$ [s/d] |
|---|---|---|---|---|---|---|
| 01 | R | 10 | 668 | 4 | 0.01 | 0.0 |
| 02 | E | 15 | 652 | 4 | −0.46 | −0.8 |
| 03 | E | 8 | 668 | 4 | −0.59 | −0.8 |
| 04 | E | 15 | 652 | 1 | 0.56 | 1.7 |

R = recrystallised,
E = cold-rolled

Samples 01 to 04 have hydrogen contents comprised between 0.3 and 1 wt %. All samples have a middle-temperature error comprised between −3 and +3 s/d as desired with values close to 0 for the samples treated at a hydrogen pressure of 4 bar. The CT also lies within the range −0.6 to +0.6 s/d° C. as desired. The optimum is obtained for sample 01, for which the thermochemical treatment was carried out on a recrystallised structure, the thermal coefficient and the middle-temperature error being close to 0 expressed in s/d° C. and s/d respectively. This sample has a hydrogen content of the order of 0.6 wt %.

Figure 2:
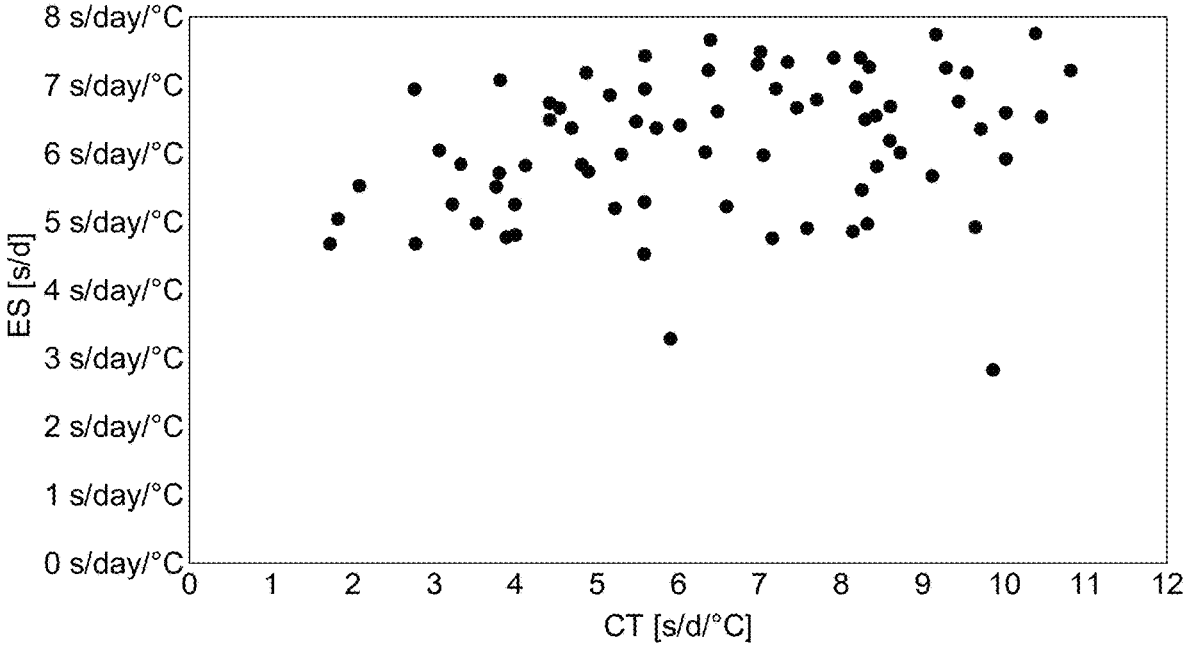
Fig. 2 (PRIOR ART)
FIG. 2 shows the middle-temperature error as a function of the thermal coefficient for binary Nb—Ti grades according to the prior art with 47 wt % Ti.

The results for samples 01 to 04 are plotted in FIG. 1 with the middle-temperature error (ES) as a function of the thermal coefficient (CT). In general, a direct link was observed between the CT and the ES when the alloy of the balance spring contains hydrogen. This is in contrast to what has been observed in past tests with a binary alloy with 47 wt % titanium and 53 wt % niobium. In the latter case, as shown in FIG. 2, there is no relationship between the CT and the ES. Plotting these two quantities on the same graph gives a scatter diagram, regardless of the parameters of the method for manufacturing the samples. Furthermore, points where CT=ES=0 are never obtained, whereas this is the case for ternary Nb—Ti—H grades. Thus, it was found that the addition of hydrogen allows the middle-temperature error to be controlled while keeping the CT low.

Figure 3:
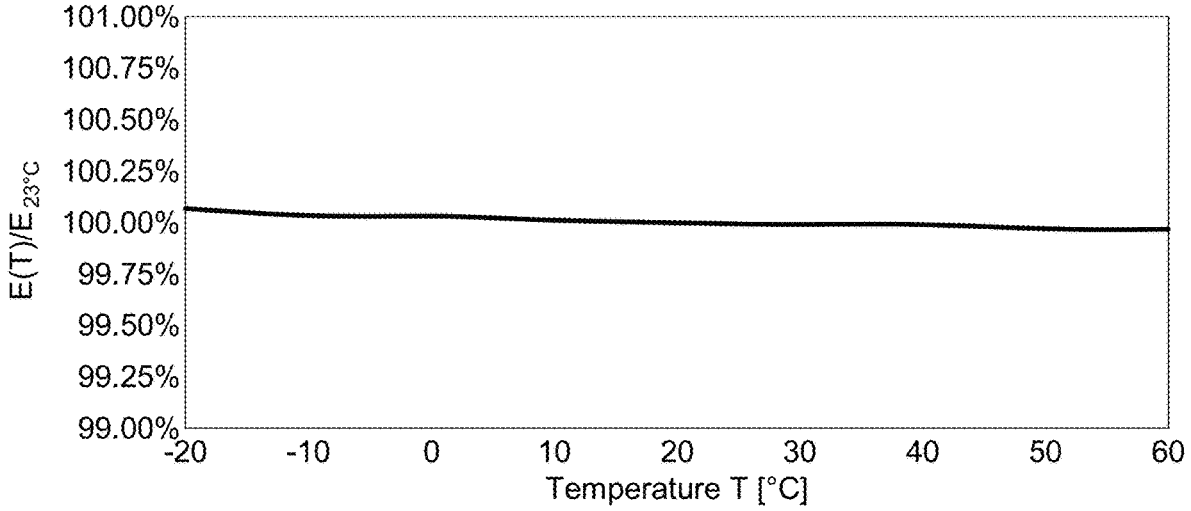
FIG. 3 shows the variation of the Young's modulus with temperature for a Nb—Ti—H alloy according to the invention which has been subjected to a thermochemical treatment at 652° C. for 15 minutes under 4-bar hydrogen. In the representation, the Young's modulus is normalised to the Young's modulus at 23° C.

The influence of temperature on the Young's modulus of sample 02 was also measured continuously using a mechanical spectrometer measuring the natural frequency of a freely vibrating beam, over a range of −20° C. to +60° C. (FIG. 3). Little influence of temperature on the Young's modulus is observed.

Figure 4:
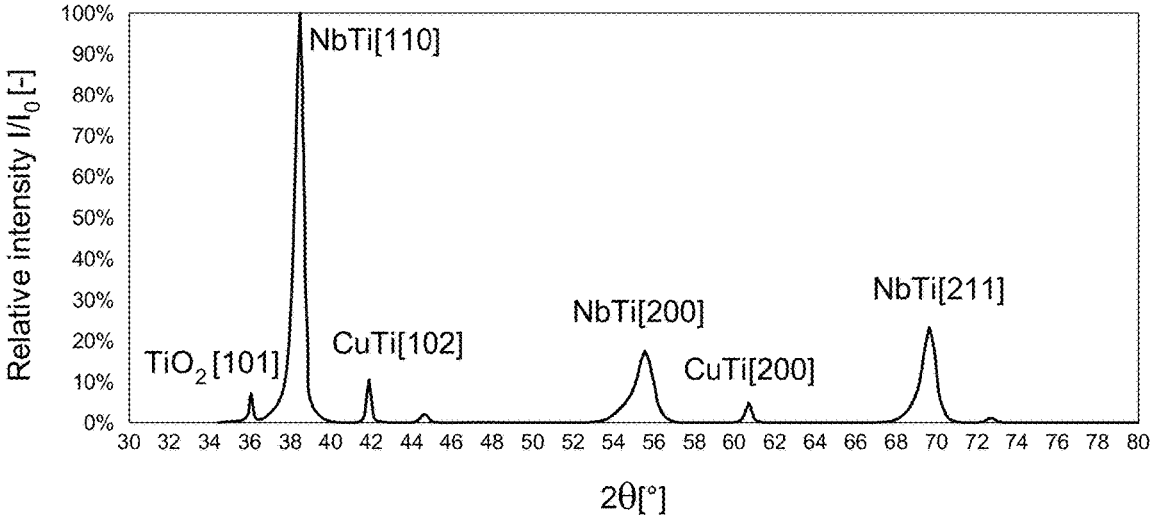
FIG. 4 shows the X-ray diffraction pattern (XRD pattern) for the same alloy.
Figure 5:
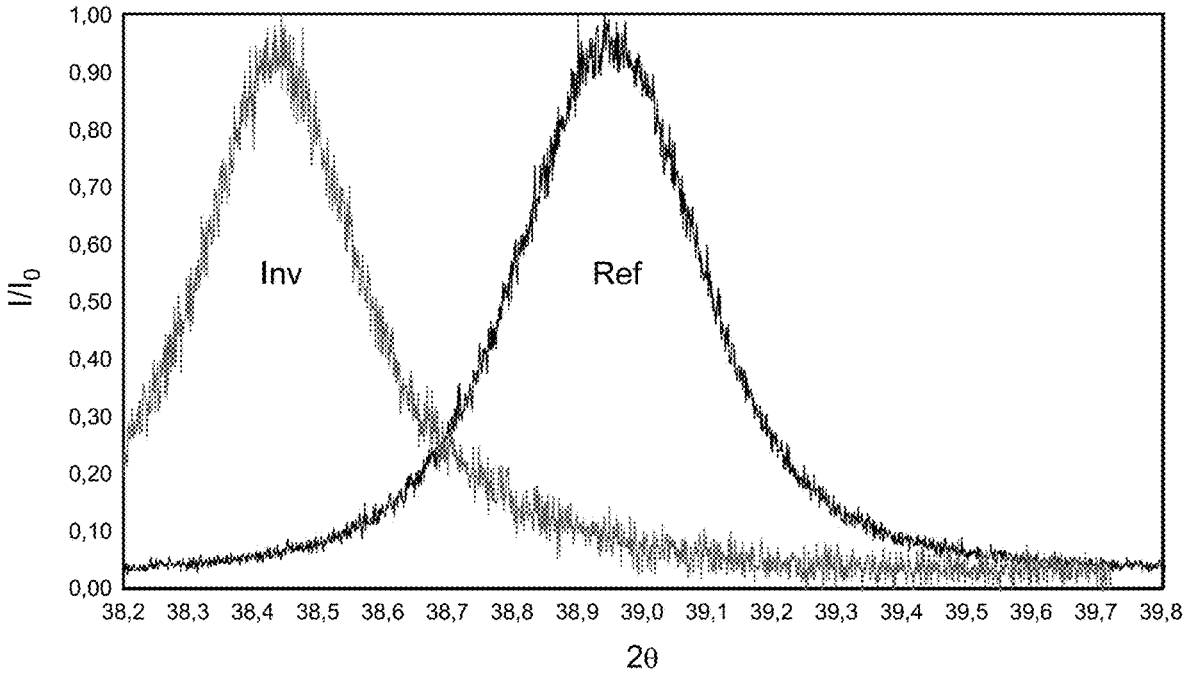
FIG. 5 shows an enlargement of this XRD pattern centred at 8=39° for the left-hand peak (Inv) with the reference peak (Ref) on the right in the absence of any thermochemical treatment.

An X-ray diffraction analysis (Bragg-Brentano configuration) was carried out on the same sample. The diffraction spectrum is shown in FIG. 4. The XRD pattern between 30° and 80° does not indicate the presence of $TiH_2$ or NbH hydride phases. By zooming in on FIG. 5, focusing on 8=39°, which corresponds to the area of the NbTi peak [110], it can be seen that this is shifted towards the left (Inv peak) following the thermochemical treatment compared to the reference peak (Ref peak) without thermochemical treatment, which is indicative of an increase in the lattice parameter. It can be concluded that the thermochemical treatment allows hydrogen to be introduced in interstitial form without forming hydrides. Furthermore, no precipitation of the alpha-titanium is observed. The absence of titanium precipitates is attributed to the presence of hydrogen, which stabilises the beta phase of the titanium.

The invention claimed is:

1. A balance spring to equip a balance of a horological movement, wherein the balance spring is made of an alloy consisting of Nb, Ti, H and at least one other element selected from the group consisting of O, C, Fe, N, Ni, Si, Cu and Al, wherein a Ti content is between 1 and 50 wt %, a H content is between 0.6 and 1 wt %, a total content of the at least one other element is less than or equal to 0.3 wt %, and the remainder consists of Nb, wherein the balance spring has a thermal coefficient, or CT, of between −0.6 and +0.6 s/d° C., and a middle-temperature error, or ES, of between −0.8 and 0 s/d.

2. The balance spring according to claim 1, wherein the H content is 0.6 wt %.

3. The balance spring according to claim 1, wherein the Ti content is between 20 and 50 wt %.

4. The balance spring according to claim 1, wherein H is present predominantly or exclusively in interstitial form in the alloy.

5. The balance spring according to claim 1, wherein the alloy has a microstructure formed by a single beta phase of Nb and Ti in a solid solution.

6. The balance spring according to claim 1, having the thermal coefficient, or CT, of between −0.6 and +0.01 s/d° C.

7. The balance spring according to claim 1, wherein the Ti content is between 40 and 50 wt %.

8. A method for manufacturing a balance spring to equip a balance of a horological movement, successively comprising:

a) producing or supplying a blank made of an alloy consisting of Nb, Ti and at least one other element selected from the group consisting of O, C, Fe, N, Ni, Si, Cu and Al, with a Ti content of between 1 and 50 wt % and a total content of the at least one other element of less than or equal to 0.3 wt %, the remainder consisting of Nb;

b) beta-type solution treating and quenching the blank, such that the titanium and niobium of the alloy are essentially in the form of a beta-phase solid solution;

c) applying to the alloy a succession of deformation sequences optionally with at least one heat treatment carried out between two deformation sequences and/or at the end of all of the deformation sequences;

d) winding the alloy to form the balance spring; and e) subjecting the alloy to a final fixing heat treatment, wherein the method further comprises:

subjecting the alloy to a thermochemical treatment in an atmosphere comprising hydrogen, the thermochemical treatment being carried out during the solution treatment of b), during the heat treatment of c), during the final fixing heat treatment of e), before b), between b) and c), between c) and d), between d) and e) or after e), wherein the balance spring has a H content of between 0.6 and 1 wt % based on a total weight of the balance spring and a thermal coefficient, or CT, of between −0.6 and +0.6 s/d° C., and a middle-temperature error, or ES, of between −0.8 and 0 s/d.

9. The method according to claim 8, wherein the thermochemical treatment is carried out in e).

10. The method according to claim 8, wherein the thermochemical treatment is carried out on a structure of the blank or balance spring in the recrystallised state.

11. The method according to claim 8, wherein the thermochemical treatment is carried out at a temperature of between 100 and 900° C. in an atmosphere comprising 100% hydrogen at a hydrogen pressure of between 5 mbar and 10 bar, or is carried out in an atmosphere comprising a mixture of hydrogen and another gas with a volume percentage of hydrogen of between 5 and 90 vol %, the total pressure of the mixture being between 5 mbar and 10 bar.

12. The method according to claim 8, wherein the hydrogen pressure or the total pressure of the mixture is between 0.5 and 7 bar.

13. The method according to claim 8, wherein the temperature is between 500 and 800° C.

14. The method according to claim 8, wherein the hydrogen pressure or the total pressure of the mixture is between 3.5 and 4.5 bar and the temperature is between 600 and 700° C.

15. The method according to claim 8, wherein the solution treatment is carried out in a vacuum at a temperature of between 600° C. and 1,000° C. for a duration of between 5 minutes and 2 hours, followed by cooling under a gas.

16. The method according to claim 8, wherein after the producing or supplying the blank in a), and before the applying the succession of deformation sequences in c), a surface layer of ductile material selected from the group consisting of copper, nickel, cupronickel, cupromanganese, gold, silver, nickel-phosphorus Ni—P and nickel-boron Ni—B, is added to the blank to ease the wire shaping operation and wherein, before or after the winding in d), the layer of the ductile material is removed from the wire by etching.

17. The method according to claim 8, wherein the hydrogen pressure or the total pressure of the mixture is between 1 and 6 bar.

18. The method according to claim 8, wherein the hydrogen pressure or the total pressure of the mixture is between 3.5 and 4.5 bar.

19. The method according to claim 8, wherein the temperature is between 600 and 700° C.

* * * * *